US006907632B2

(12) United States Patent
Bourgraf, Jr.

(10) Patent No.: US 6,907,632 B2
(45) Date of Patent: Jun. 21, 2005

(54) TACTICAL STRETCHER

(75) Inventor: Elroy Edwin Bourgraf, Jr., Mainville, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 0 days.

(21) Appl. No.: 10/446,633

(22) Filed: May 28, 2003

(65) Prior Publication Data

US 2004/0010852 A1 Jan. 22, 2004

Related U.S. Application Data

(60) Provisional application No. 60/383,540, filed on May 28, 2002.

(51) Int. Cl.[7] ..... A61G 1/013; A61G 1/048
(52) U.S. Cl. ..... 5/627; 5/625; 16/430
(58) Field of Search ..... 5/625–628; 16/430, 16/114.1

(56) References Cited

U.S. PATENT DOCUMENTS

| | | | | |
|---|---|---|---|---|
| 1,764,477 A | | 6/1930 | Weber-Stierlin | |
| 1,857,008 A | * | 5/1932 | Adcock | 5/627 |
| 2,133,692 A | | 10/1938 | Gittings et al. | |
| 2,203,193 A | | 6/1940 | Ettinger | |
| 2,226,306 A | | 12/1940 | Ettinger | |
| 2,276,265 A | | 3/1942 | Sturtz | |
| 2,327,919 A | | 8/1943 | Montgomery | |
| 2,355,140 A | | 8/1944 | Bludworth | |
| 2,360,371 A | | 10/1944 | Schwichtenberg | |
| 2,394,245 A | | 2/1946 | Koller | |
| 3,110,912 A | | 11/1963 | Propst | |
| 3,797,051 A | | 3/1974 | Evans | |
| 3,859,677 A | | 1/1975 | Nordwig | |
| 3,886,606 A | | 6/1975 | Bradford | |
| 3,956,781 A | | 5/1976 | Reemelin | |
| 4,403,052 A | | 9/1983 | Largman et al. | |
| 4,670,921 A | | 6/1987 | Avni et al. | |
| 4,783,862 A | | 11/1988 | Murphy | |
| D301,021 S | | 5/1989 | Dommerud | |
| D309,589 S | | 7/1990 | Hare et al. | |
| 4,947,418 A | | 8/1990 | Barr et al. | |
| 5,154,487 A | | 10/1992 | Warburton | |
| 5,317,770 A | | 6/1994 | Sakurai | |
| 5,598,592 A | | 2/1997 | Castellani | |

* cited by examiner

*Primary Examiner*—Alexander Grosz
(74) *Attorney, Agent, or Firm*—Dinsmore & Shohl LLP

(57) ABSTRACT

A tactical stretcher used to transport accident victims, in particular, to stretcher type devices used to transport victims who have been exposed to hazardous materials is disclosed. The tactical stretcher comprises a foldable tubular frame having spreader assemblies attached thereto for securing the stretcher in a folded or unfolded position, the folded position having reduced width. The frame is coated with chemical resistant paint, and includes integral handles swedged into the ends of the frame. Each integral swedged handle has alternate grooves and ridges to provide a firm grip, and reduce hand and arm fatigue for a user wearing heavy rubber gloves. A bed spans the frame for carrying the accident victim thereon.

20 Claims, 2 Drawing Sheets

TACTICAL STRETCHER

BACKGROUND OF THE INVENTION

This invention relates to stretcher type devices used to transport accident victims, in particular, to stretcher type devices used to transport injured victims who have been exposed to hazardous materials.

The transportation of injured victims exposed to hazardous materials poses unique challenges for emergency service personnel. The victim must be removed safely and quickly from the area of the hazardous material. Then, the victim must be decontaminated. The purpose of decontamination is to remove the hazardous material from the exposed victim and to dilute the chemical to the point where it no longer poses threat of injury or harm to an individual. Finally, the victim must be transported to appropriate medical treatment facilities by ambulance, helicopter, or other appropriate means.

Current procedures require that an exposed, injured victim be moved from the location of exposure to a decontamination point using a stretcher type device. At the decontamination point, the victim may be transferred to a decontamination table. Following decontamination, the victim is transferred to a second uncontaminated stretcher type device.

Although attempts have been made to decontaminate an injured victim without the necessity of transferring the victim to a decontamination table and/or a second uncontaminated stretcher type device thereafter to reduce further injury, further improvements in prior art stretcher designs are still needed to meet this desire.

SUMMARY OF THE INVENTION

The stretcher of the present invention meets this need. It eliminates the need to transfer a patient from a first stretcher to a decontamination table and/or a second uncontaminated stretcher type device. The stretcher of the present invention is made of materials which do not react with hazardous materials and which may be easily decontaminated when the patient is decontaminated. Additionally, the stretcher of the present invention has fewer parts than similar prior art stretchers, thereby reducing the number of unions or joining points at which contaminates may reside and/or enter into the interior of the stretcher's frame. Having fewer joining points therefore reduces the difficulty of decontaminating the stretcher. Furthermore, reducing the number of parts increasing manufacturing efficiency by reducing cost and the amount of assembly required.

In one embodiment of the invention provided is a folding stretcher comprising a frame constructed of a pair of tubular poles, spreader assemblies connected between the poles for securing the stretcher in a folded or unfolded position, the folded position having reduced width. Swedged handles are integrally formed at ends of the poles. A bed is attached to the poles by a sleeve at each side of the bed.

In another embodiment of the invention provided is a folding stretcher comprising a frame constructed of a pair of tubular poles and having a chemical resistant finish. Spreader assemblies are connected between the poles for securing the stretcher in a folded or unfolded position, the folded position having reduced width. Stirrups are provided to the poles. Hinges are provided at the middle of each pole's length. The hinges are adapted to reduce the length of the frame by half. Swedged handles are integrally formed at ends of the poles. A bed having restraint straps is attached to the poles by a sleeve at each side of the bed.

In still another embodiment of the invention, a process of decontaminating an injured person contaminated by exposure to a hazardous material at a contaminated site is provided. The method comprises placing the contaminated person on a stretcher having a frame constructed of a pair of tubular poles, spreader assemblies connected between the poles for securing the stretcher in a folded or unfolded position, the folded position having reduced width. The stretcher further includes swedged handles integrally formed at ends of the poles, and a bed attached to the poles by a sleeve at each side of the bed. The method further comprises transporting the contaminated person to an area away from the contaminated site and free of hazardous material, and decontaminating the contaminated person with water or other decontaminating solvents appropriate to the specific hazardous material while the contaminated person is on the stretcher.

These and other features and objects of the present invention will be apparent in light of the description of the invention embodied herein.

BRIEF DESCRIPTION OF THE DRAWINGS

The following detailed description of the embodiments of the present invention can be best understood when read in conjunction with the following drawings, where like structure is indicated with like reference numerals and in which.

DETAILED DESCRIPTION OF THE EMBODIMENTS OF THE INVENTION

It is noted that the drawings of the invention are not to scale. The drawings are intended to depict only typical embodiments of the invention, and therefore should not be considered as limiting the scope of the invention.

By "hazardous materials" we mean materials such as hazardous, dangerous, or unsafe chemicals, radioactive or poisonous elements, human body fluids, chemicals constituting a fire hazard, when appropriate, chemicals used to decontaminate victims, such as a weak acid wash used to decontaminate victims contaminated with an alkaline solution, and the like.

Figure 1:
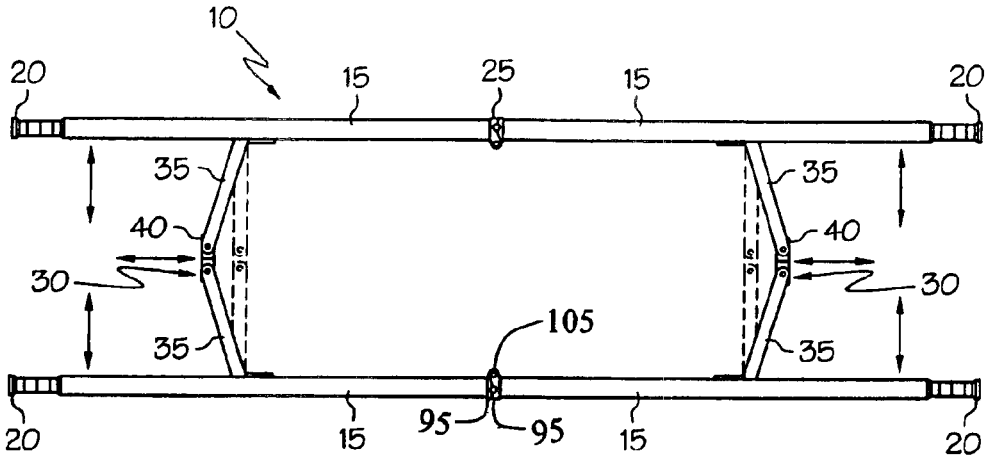
FIG. 1 is a top view of one embodiment of a stretcher frame according to the present invention in a substantially unfolded position.
Figure 5:
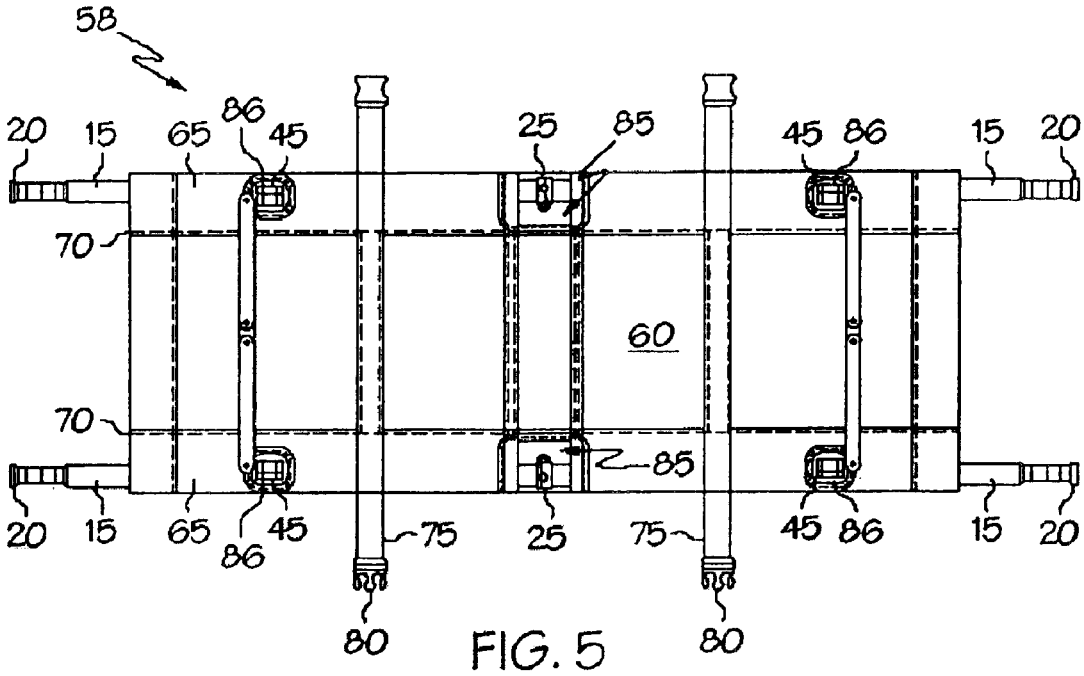
FIG. 5 is a bottom view of one embodiment of a stretcher according to the present invention in a fully unfolded position.

FIG. 1 shows the top of one embodiment of a folding stretcher frame 10 in a substantially unfolded position. FIG. 1 shows two pairs of tubular poles 15 with integral handles 20. Each pair of poles 15 is connected with hinges 25, such that they may be folded in half to make the stretcher frame more compact for transporting and storage. The pairs of poles 15 are connected to each other with spreader assemblies 30. The spreader assemblies 30 include spreader bars 35 pivotally attached at one end to poles 15 and pivotally attached at the other end to coupler 40. The spreader assemblies 30 are positionable in either a folded compact position that situates poles 15 substantially together or an extended position that spreads poles 15 apart and holds the stretcher frame 10 in a fully unfolded position (FIG. 5).

Figure 2A:
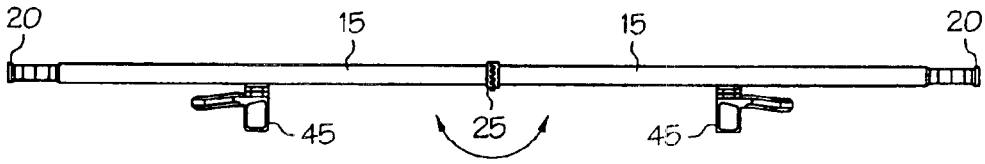
FIGS. 2*a* and 2*b* are exterior and interior side views, respectively, of one embodiment of a stretcher frame according to the present invention in an unfolded position.
Figure 2B:
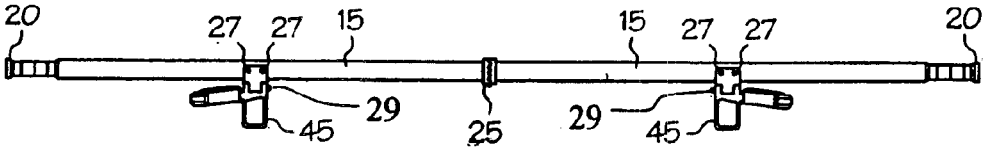

FIGS. 2*a* and 2*b* show outside and inside side views, respectively, of the stretcher frame 10 of FIG. 1. The poles 15 are connected by hinge assembly 25. Each pole 15 has an integral handle 20. There are stirrups 45 attached to each tubular pole 15 between the hinges 25 and the integral handle 20. It is to be appreciated that the stirrups 45 act as feet which support the stretcher frame 10 above a surface when the stretcher is placed on the surface. The stirrups 45 are rotatably attached to the poles 15, via pins 29, such that when the stretcher frame is not used in the illustrated fully extended position, the poles 15 may be turned inward such as illustrated by FIG. 3, positioning pins 105 of hinges 25 substantially downwards, thereby permitting the stretcher frame to fold in half for storage.

In the embodiment illustrated by FIG. 2*b*, the stirrups 45 are attached to poles 15 via bolts 27. Bolting the stirrups 45 to poles 15 permits the stirrups 45 to be unbolted and removed, thereby conveniently facilitating the slipping off the poles 15 a stretcher bed 60 (FIG. 5) when worn or damaged, and also the slipping on the poles 15 a replacement bed. A more detailed discussion regarding the stretcher bed 60 is provided in a later section in reference to FIG. 5.

In an alternative embodiment, the stirrups 45 are made fast to the poles 15, such as by welding, and the spreader assemblies 30 are removably attached thereto, such as via bolting. In this embodiment, the bed 60 may also be conveniently slipped off the poles 15 and replaced by removing the spreader assemblies 30, and folding the stirrups 45 compactly against the poles 15.

Figure 3:
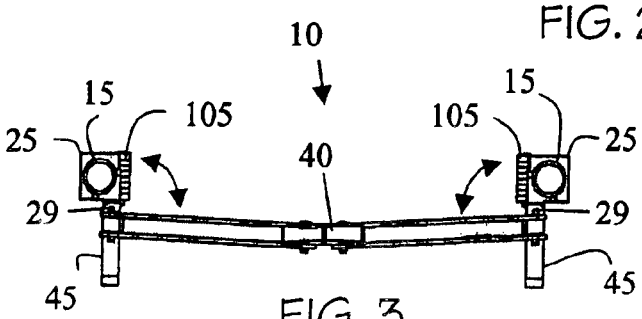
FIG. 3 is an end view of one embodiment of a stretcher frame according to the present invention in an unfolded position.

FIG. 3 shows the end of the stretcher frame 10. Each spreader assembly 30 includes spreader bars 35 that are pivotally attached at one of their ends to poles 15. The other ends of the spreader bars 35 are pivotally attached to a coupler 40. This pivotal attachment of each spreader assembly 30 allows the stretcher frame 10 to be collapsed widthwise so that the poles 15 are next to each other in the collapsed position.

Figure 4:
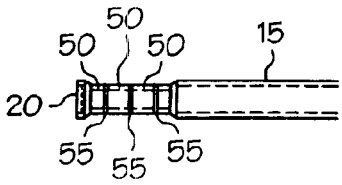
FIG. 4 is a view of a portion of one of the poles of a stretcher frame according to the present invention showing a swedged handle.

FIG. 4 shows a portion of one of the poles 15 with the integral handle 20. Integral handle 20 is formed by swedging, or crimping, the end of pole 15. Swedging forms alternating grooves 50 and ridges 55 of the integral handle 20. The grooves and ridges allow a person who is lifting the stretcher while wearing heavy rubber gloves to obtain a secure grip. In one embodiment, each handle 20 is formed in such a manner which leaves an opening at the end of the pole 15. This opening is then sealed with an end plug (not shown). In another embodiment, the end of the pole 15 is fully sealed by the forming process, thereby eliminating the need for an end plug. In order to make a swedged fitting, the terminal end of the tube is squeezed between two swedging members to form the desired shape.

Because the handle is formed from the end of the pole, no fasteners are needed to attach each handle 20 to its respective pole 15. Therefore, the integral handle 20 of the present invention cannot fall off. With handles attached using fasteners, such as with conventional stretchers, if the fasteners fail, the handle could fall off, and the stretcher could be dropped, injuring the patient. In addition, fewer parts are necessary to make the stretcher with swedged handles 20, thereby reducing the complexity and cost of manufacture. Furthermore, without having a handle to attach to the ends of the tubular members, decontamination is less extensive as there is no seam with the swedged handle 20 at the grip and pole interface as there is in other prior art tactical stretchers.

FIG. 5 shows a bottom view of a stretcher 58 comprising the stretcher frame 10 in the unfolded position with the stretcher bed 60 attached. The stretcher bed 60 is made of fabric woven in the form of large honeycomb net. Fabric suitable for decontamination typically has about 40% of the surface area open to allow liquid to pass through; however, materials with 10% to 90% of the surface area open to allow liquid to pass through are also suitable for use.

The bed material is made of strong, flexible, flame-retardant, and UV protected monofilament polypropylene fibers which are resistant to hazardous materials, fire, and UV light. Flame retardant properties may be obtained by including in the monofilament polyopylene fibers 13% PT Conc.33, from Mammoth Plastics. UV light protection may be obtained from the inclusion of carbon black in the monofilament polypropylene. The bed fiber preferably is continuous monofilament polypropylene which is woven into a honeycomb and 3/3 broken twill. Polypropylene monofilament is suitable for use in stretcher beds because it is resistant to hazardous materials, fire, and UV light. Other bed fibers that may be suitable to a greater or lesser degree include, but are not limited to, polyester, polyamides, and a blend of polyester and polyamide.

Loops 65 are formed along the length of the stretcher bed 60 on each side and are used to receive the tubular poles 15. Each loop 65 is form by a hem 70 running along the length of each side of the stretcher bed 60. The hem may be formed by cuffing or rolling the sides of the bed material through out the length of the stretcher bed 60. The stitching is typically double needle locking with polyester thread. Other threads may be used, such as polyamides, or blends of polyester and polyamides. The hem may be reinforced with a reinforcing ribbon sewn into the hem using stitching. Using the reinforcing ribbon with the hem makes it possible to use the honeycomb mesh throughout the width of the stretcher bed. Hemming without a reinforcing ribbon may result in a hem without adequate strength to support patients. Using a hem with a reinforcing ribbon allows a more open stretcher bed, which aids the decontamination process.

The alternative reinforcing ribbon and the straps are made of the same materials as the fibers of the bed material. The reinforcing ribbon may differ from the bed material in that it is closely woven as opposed to being woven in a honeycomb net or mesh. A suitable material for the reinforcing ribbon is monofilament polypropylene in a 3/3 broken twill weave or a trampoline style weave. Alternatively, the reinforcing ribbon may be a non-woven solid webbing of monofilament polypropylene or other materials suitable for the bed. Use of the reinforcing ribbon when desired provides additional strength to the hemming of the honeycomb net or mesh stretcher bed.

There are two restraining straps 75 for retaining the patient on the stretcher. The straps 75 may be attached to the stretcher bed 60. Alternatively, the straps could be attached to the tubular poles 15 by a fastener. The straps 75 may be made of suitable strong, hazardous material-, fire-, and UV light-resistant materials, such as 3/3 broken twill monofilament polypropylene and materials suitable for the bed.

When a patient is on the stretcher 58, the ends of the straps 75 are connected by buckles 80, thereby securing the patient to the stretcher. The buckles 80 can be side release buckles, which allow easy use with heavy gloves. Other types of closures may be used, including, but not limited to hook and loop closures, and other buckle arrangements. Each buckle 80 can be made of polypropylene which is resistant to hazardous materials. Other materials may be used such as metals coated with chemical resistant paint, chemical resistant metals, polyamide, polyester, high-density polyethylene, and acrylic.

Figure 6A:
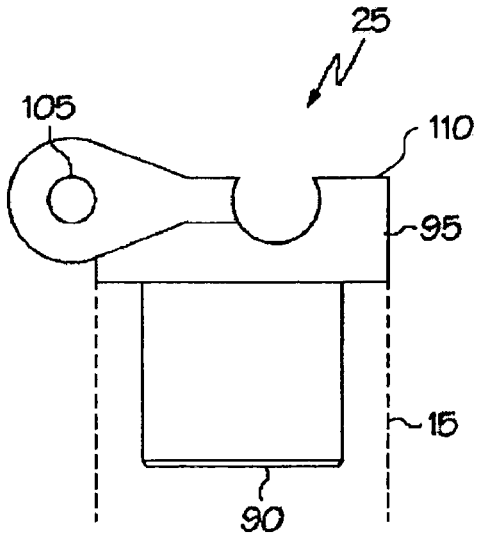
FIGS. 6*a* and 6*b* are top and side views, respectively, showing half of a hinge according to the present invention for the stretcher poles.
Figure 6B:
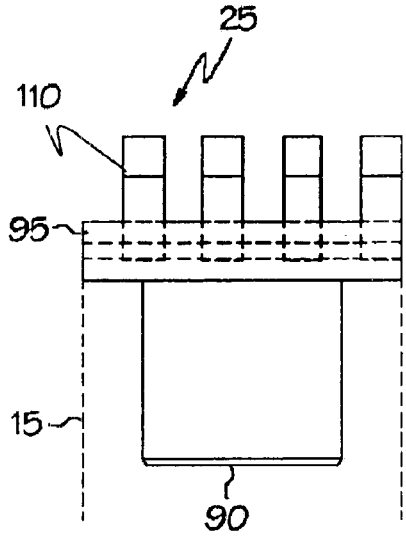

As shown by FIG. 5, the stretcher bed 60 further has a cutout 85 surrounding each hinge 25 to allow operation of the hinges 25 without interference from the stretcher bed 60. A similar cutout 86 is also provided around each stirrup 45 for the same purpose. With regards to each hinge, FIGS. 6*a* and 6*b* show half of hinge 25 which can be used in the present invention. The hinge 25 includes a pole insert portion 90 and complimentary jaws-shaped members 95. The pole insert 90 is inserted into pole 15 shown in dotted lines. The pole insert 90 can be attached to pole 15 by any suitable means, such as threads, crimping, welding, or using a sealing material. The complimentary jaws-shaped members 95, which are best shown by FIG. 1, are pivotally attached together by pin 105. The hinge 25 only folds in one direction, thereby allowing the stretcher to be collapsed, reducing the length by approximately one half to facilitate storage and transportation of the folded stretcher 58. It is to be appreciated that hinge 25 opens outwardly and that teeth 110 (FIGS. 6*a* and 6*b*) of each jaws-shaped member 95 mesh with their counterpart member 95 when the hinge is closed. As best illustrated by FIG. 2*a*, the teeth 110 of the hinge 25 are horizontally orientated parallel to each other when situated together, thereby adding strength and rigidity of the tubular pole 15 when the stretcher 58 is used to support or carry a person. To unlock the hinges 25, the spreader bars 35 are first partially folded as illustrated in FIG. 1, then the stretcher poles 15 are both rotated 90° as shown in FIG. 3. The rotation turns the hinges 25 to a position where they can open, allowing the stretcher 10 to then fold in half, which is indicated by the arrows shown in FIG. 2*a*.

The tubular poles 15 and other elements of the stretcher frame 10 may be constructed of a strong, light metal, including, but not limited to aluminum, titanium, steel, copper, and alloys of these metals. The stretcher frame 10 may be coated with a chemical resistant paint to protect it from hazardous materials and weathering. A typical chemical resistant paint is polyurethane. Other chemical resistant paints may be used, including, but not limited to, epoxy, hybrid, or polyester paints.

The decontaminatable stretchers of this invention may be used as any conventional folding or folding and collapsible stretcher. The stretcher 58 of the present invention may be used to transport a contaminated patient from a contaminated environment, the patient may be decontaminated while on the stretcher, and the stretcher may be used to transport the patient from the contaminated environment to a medical facility. The decontamination process used to decontaminate the patient is spraying, washing, or blotting the patient with water, detergent solution in water, or other required chemical decontaminate solutions. This also serves to decontaminate the stretcher 58.

Use of the present stretcher 58 has the advantage of eliminating the current need to transfer the patient from the first contaminated stretcher to a decontamination table and/or a second stretcher type device or backboard at the decontamination site. This reduces the chance of additional injury or aggravation of previous injuries to the patient while also reducing the time required for the decontamination process. In addition, the present stretcher 58 with fewer joined parts reduces the risk of hazardous materials remaining with the stretcher after decontamination. Use of the present stretcher 58 therefore avoids the delay and potential injury associated with the decontamination process and transferring a patient from one support to another, and avoids the cost of additional stretchers or backboards.

While certain representative embodiments and details have been shown for purposes of illustrating the invention, it will be apparent to those skilled in the art that various changes in the compositions and methods disclosed herein may be made without departing from the scope of the invention, which is defined in the appended claims.

What is claimed is:

1. A folding stretcher comprising:

a frame constructed of a pair of tubular poles, spreader assemblies connected between said poles for securing the stretcher in a folded or unfolded position, the folded position having reduced width;

a pair of hinges adapted to reduce the length of said frame, each said hinges having complimentary jaws-shaped members with meshing teeth, thereby adding strength and rigidity to the stretcher when in said unfolded position;

crimped handles integrally formed at ends of said poles, thereby reducing the number of joining points at which contaminates may reside and enter inside said frame; and a bed attached to said poles by a sleeve at each side of said bed.

2. The folding stretcher as recited by claim 1, wherein said hinges are adapted to reduce the length of the frame by half.

3. The folding stretcher as recited by claim 1, further comprising stirrups provided to said poles.

4. The folding stretcher as recited by claim 1, further comprising the frame having a chemical resistant finish.

5. The folding stretcher as recited by claim 1, wherein said handles have alternate grooves and ridges.

6. The folding stretcher as recited by claim 1, wherein said bed comprises a fabric woven of flame retardant and UV protected mono filament polypropylene.

7. The folding stretcher as recited by claim 1, wherein said poles are a strong, light metal.

8. The folding stretcher as recited by claim 1, wherein the stretcher further comprises restraint straps provided to the bed.

9. The folding stretcher as recited by claim 1, wherein said bed comprises a material selected from the group consisting of polypropylene, polyester, polyamides, and a blend of polyester and polyamide.

10. The folding stretcher as recited by claim 1, wherein said handles seal the ends of said poles.

11. A folding stretcher comprising:

a frame constructed of a pair of tubular poles and having a chemical resistant finish;

collapsible spreader assemblies connected between said poles for securing the stretcher in a folded or unfolded position, the folded position having reduced width;

stirrups provided to said poles;

a pair of hinges provided to said tubular poles, said hinges are adapted to reduce the length of the frame by half, each said hinges having complimentary jaws-shaped members with meshing teeth, thereby adding strength and rigidity to the stretcher when in said unfolded position;

crimped handles integrally formed at ends of said tubular poles, thereby reducing the number of joining points at which contaminates may reside and enter inside said frame; and a bed having restraint straps, said bed is attached to said poles by a sleeve at each side of said bed.

12. The folded stretcher as recited by claim 11, wherein said spreader assemblies are removably attached to said stirrups.

13. The folded stretcher as recited by claim 11, wherein said spreader assemblies are attached to said stirrups, and said stirrups are removably attached to said poles.

14. The folding stretcher as recited by claim 11, wherein said chemical resistant finish is a chemical resistant paint selected from the group consisting of polyurethane, epoxy, polyester, and combinations thereof.

15. The folding stretcher as recited by claim 11, wherein said restraint straps include buckles and are comprised of polypropylene.

16. The folding stretcher as recited by claim 11, wherein said poles are a metal selected from the group consisting of aluminum, titanium, steel, copper, and alloys of these metals.

17. The folded stretcher as recited by claim 11, wherein said stirrups are removably and rotatably attached to said poles.

18. The folding stretcher as recited by claim 11, wherein said complimentary jaws-shaped members each having a pole insert portion mounted to a respective pole.

19. The folding stretcher as recited by claim 18, wherein said meshing teeth are horizontally orientated parallel to each other when situated together.

20. A folding stretcher comprising:

a frame constructed of a pair of tubular metal poles and having a chemical resistant finish;

collapsible spreader assemblies connected between said poles for securing the stretcher in a folded or unfolded position, the folded position having reduced width;

stirrups provided to said poles;

a pair of hinges provided to said tubular poles, said hinges are adapted to reduce the length of the frame by half;

crimped handles integrally formed at ends of said poles, said handles seal the ends of said poles and have alternate grooves and ridges, thereby reducing the number of joining points at which contaminates may reside and enter inside said frame; and a bed having restraint straps, said bed is attached to said poles by a sleeve at each side of said bed.

* * * * *

US006907632C1

(12) EX PARTE REEXAMINATION CERTIFICATE (6094th)

United States Patent
Bourgraf, Jr.

(10) Number: US 6,907,632 C1
(45) Certificate Issued: Jan. 8, 2008

(54) TACTICAL STRETCHER

(75) Inventor: Elroy Edwin Bourgraf, Jr., Mainville, OH (US)

(73) Assignee: Ferno-Washington, Inc., Wilmington, OH (US)

Reexamination Request:
No. 90/007,998, Apr. 11, 2006

Reexamination Certificate for:

| | |
|---|---|
| Patent No.: | **6,907,632** |
| Issued: | **Jun. 21, 2005** |
| Appl. No.: | **10/446,633** |
| Filed: | **May 28, 2003** |

Related U.S. Application Data

(60) Provisional application No. 60/383,540, filed on May 28, 2002.

(51) Int. Cl.
*A61G 1/013* (2006.01)
*A61G 1/048* (2006.01)

(52) U.S. Cl. ..... 5/627; 5/625; 16/340

(58) Field of Classification Search ..... None
See application file for complete search history.

(56) References Cited

U.S. PATENT DOCUMENTS

| | | | | |
|---|---|---|---|---|
| 4,667,355 A | | 5/1987 | Nishijima et al. | |
| 5,179,746 A | * | 1/1993 | Rogers | 5/625 |
| 5,598,592 A | | 2/1997 | Castellani | |
| 6,907,632 B2 | | 6/2005 | Bourgraf, Jr. | |

FOREIGN PATENT DOCUMENTS

| | | | |
|---|---|---|---|
| EP | 0 263 628 A2 | | 4/1988 |
| GB | 2119260 | * | 11/1993 |

* cited by examiner

*Primary Examiner*—Jeffrey R. Jastrzab

(57) ABSTRACT

A tactical stretcher used to transport accident victims, in particular, to stretcher type devices used to transport victims who have been exposed to hazardous materials is disclosed. The tactical stretcher comprises a foldable tubular frame having spreader assemblies attached thereto for securing the stretcher in a folded or unfolded position, the folded position having reduced width. The frame is coated with chemical resistant paint, and includes integral handles swedged into the ends of the frame. Each integral swedged handle has alternate grooves and ridges to provide a firm grip, and reduce hand and arm fatigue for a user wearing heavy rubber gloves. A bed spans the frame for carrying the accident victim thereon.

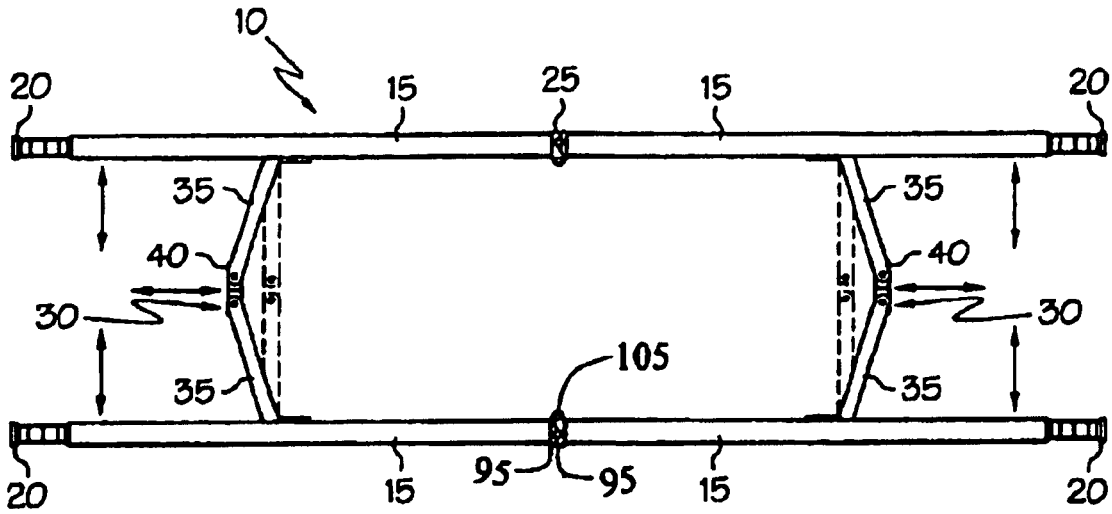

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–20 are cancelled.

* * * * *